US007484991B1

(12) United States Patent
Kelaher et al.

(10) Patent No.: US 7,484,991 B1
(45) Date of Patent: Feb. 3, 2009

(54) PANEL-MOUNT USB LOCKING LATCH

(75) Inventors: Daniel Paul Kelaher, Holly Springs, NC (US); Jeffrey John Smith, Raleigh, NC (US); David Thomas Windell, Raleigh, NC (US); Jeremy S. Bridges, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/106,045

(22) Filed: Apr. 18, 2008

(51) Int. Cl.
*H01R 13/62* (2006.01)

(52) U.S. Cl. ..... 439/372; 439/352

(58) Field of Classification Search ..... 439/352, 439/372, 607
See application file for complete search history.

(56) References Cited

U.S. PATENT DOCUMENTS 5,529,512 A * 6/1996 Mlyniec ..... 439/372
5,772,461 A 6/1998 Yu
6,139,350 A 10/2000 Mathesius
6,340,310 B2 * 1/2002 Henrici et al. ..... 439/352
6,902,432 B2 6/2005 Morikawa et al.
7,004,780 B1 2/2006 Wang
7,128,595 B2 10/2006 Boutros
7,192,295 B1 3/2007 Yeh
7,381,078 B2 * 6/2008 Mtchedlishvili et al. .... 439/352
2006/0134962 A1 6/2006 Yeh
2007/0015407 A1 1/2007 Loftus
2007/0254514 A1 * 11/2007 Weksler et al. ..... 439/296

* cited by examiner

*Primary Examiner*—Tho D Ta
(74) *Attorney, Agent, or Firm*—Patent Analysis Research Technology Systems LLC; George L. Walton

(57) ABSTRACT

A unique push-pull actuator and pivoting latching arm device for removably coupling and latching a USB male plug connector and USB female socket connector which is mounted in a first opening of a panel structure. The male plug connector has a first latching recess and the female socket connector has a second latching recess. The push-pull actuator is mounted and movable within a second opening in the panel structure. A portion of the push-pull actuator has a first incline cam element. A pivoting latch arm cooperatively associated with the female socket connector having a second incline cam element and a downward projection latch thereon. The movement of the push-pull actuator through the second opening in one direction causes the cam elements to engage one another to pivot the latch projection into the latch recesses to securely latch the male connector and the female connector together.

1 Claim, 10 Drawing Sheets

PANEL-MOUNT USB LOCKING LATCH

BACKGROUND OF THE INVENTION

1. Field of the Invention

The present invention relates to a connector assembly, more particularly to a locking or latching structure for a universal serial bus (USB) connection. This locking or latching structure being applicable for various types of connector systems, such as, all kinds of wire, connector, conversion connector, conversion wire, connector of related apparatus, or the like.

2. Description of the Related Art

It is well known today that many computer systems or other electronic equipment types utilize the coupling structure of a USB interface to a USB terminal. Typically the USB connector system includes a USB cable plug with a USB interface adapted to matingly latch or lock with a USB terminal or socket. Most of these USB coupling structures allow for a low release locking or latching force to enable a user to easily and quickly remove the USB interface from the USB terminal. Thus, most USB connector systems have very low lock strength. USB sockets are becoming ubiquitous on front and rear panels of computer systems because of their small size, and popularity.

Many of these USB connector systems are still not secure enough to prevent inadvertent or accidental pull-outs or disconnection during usage. While this may not be a problem for temporary devices on front panels of the USB connector systems, which are easy to see, can be problematic on the rear of computer systems when more permanent connections are made, such as for a printer or scanner. Note that inadvertent disconnection can lengthen processes such as troubleshooting a problem with one of these permanently connected coupling structures. These inadvertent disconnections can also interrupt data transfer or the loss of data, increasing the time necessary to complete a data transfer task or work project.

In view of the major drawbacks of the above USB connector systems, the inventors have made diligent studies and effort to provide a USB connector structure with a more secure and unique latching or locking device to prevent the USB connector structure from being easily disassembled when from an external force is applied. This latching or locking device is provided for the user in accordance with motivations of the present invention.

SUMMARY OF THE INVENTION

The main object of the present invention is to disclose a unique latching or locking device for a USB connector for providing the USB connector with a protection function, thereby preventing the USB connector from being easily disconnected when an external force is applied thereto.

Another object of the present invention is to provide a unique latching or locking device that is cooperatively mounted and associated with a computer or electronic equipment panel for retaining a USB device or cable and eliminate the risk of inadvertent unplugging of the device or cable to overcome data transfer interruption and/or data loss.

In view of the aforementioned objects, the present invention discloses a unique USB latching or locking structure that includes a sliding push-pull type actuator or button with a top portion with a smooth or flat surface and a lower portion with a first incline wedge or cam surface, the first wedge or cam surface extends substantially along a major portion of its length, and at least one pivoting latching or locking arm or member with a top surface with a second incline wedge or cam surface disposed along a front portion thereof adjacent the interior panel or wall of a computer or other electronic equipment type panel or wall (rear or front) with a second opening for accommodating or mounting the sliding push-pull actuator therein or there along from the exterior side. Optionally, to one of ordinary skill in the art, the push-pull actuator or button could be a push-push type actuator or button (details not shown in the drawings) where you push to lock or latch, then push again to unlock or unlatch, if desired. Note that this push-push type actuator or button could use a spring detent or catch mechanism, as well as other types of mechanical detents or catch mechanisms.

A USB female socket connector or enclosure being securely mounted interiorly of the panel or wall through a first opening therein, and the USB female socket connector or enclosure includes a female cavity or port disposed on a front end thereof with a terminal base disposed within the female cavity or port, the terminal base having a plurality of contact elements with front contact portions and rear end portions that are mounted to a rear wall portion of the panel on the female socket enclosure to secure the plurality of contact elements therein. The USB female socket enclosure includes a first upper spring-like latching member and a second lower spring-like latching member with a latching element on a front portion of the first and second latching members, and disposed on upper and lower surfaces of the USB female socket enclosure.

It is well known in the art, to have electrical contact track surfaces on a USB male plug connector, which will not be illustrated in the aforementioned drawings, to matingly engage with the contact elements of the terminal base as described above. The USB male plug connector includes a front connector portion that cooperates with the female socket or port from the exterior side of the panel or wall when it is to be plugged therein, the USB male plug front connector portion having a pair of spaced apart connector insert portions with a space defined there between for slidably receiving the terminal base and bringing the electrical contact elements and the contact track surfaces into engagement with one another when the male plug connector is fully inserted into the female socket connector.

The unique latching structure will now be described, which is the main novelty of the preferred invention as depicted in FIGS. 1*a*-10. The USB male plug connector having at least first and second latching recesses in the front portion of the spaced-apart connector insert portions, at least one pivoting latching or locking arm or member with a top surface with a second wedge or cam surface disposed along a front portion thereof adjacent the interior panel or wall, and the at least one pivoting latching or locking arm or member has a flat bottom surface disposed below the second wedge or cam surface that is moved between a contact and non-contact position with the front latching element of the upper spring-like latching member. Upon movement of the first wedge or cam surface relative to the second wedge or cam surface by a user moving the push-pull actuator within the second opening until they become wedged together into a tight fit, wherein the flat surface of the locking arm is forced downward directly against the upper latching member and the upper latching element, thereby causing a latching force to move the upper latching element into a latching position within the first latching recess, while simultaneously forcing and maintaining the lower latching element into the second latching recesses for securely latching or locking the male plug connector within the female socket connector.

Therefore, this unique latching or locking connector structure protects the male plug from being inadvertently unplugged or disassembled from the female socket when an external force is applied thereto.

Note that it is obvious to one of ordinary skill in the art, at the time the invention was made, to modify the male plug and female socket designs by inverting the male plug to be a female plug and inverting the female plug to be a male plug, if desired.

The aforementioned objects and advantages of the present invention will be readily clarified in the description of the preferred embodiments and the enclosed drawings of the present invention.

BRIEF DESCRIPTION OF THE DRAWINGS

The present invention may be better understood, and it's numerous objects, features, and advantages are made apparent to those skilled in the art by referencing the accompanying drawings.

DETAILED DESCRIPTION

Reference will now be made in detail to the preferred embodiments of the invention, examples of which are illustrated in the accompanying drawings. While the invention will be described in conjunction with the accompanying drawings, it will be understood that they are not intended to limit the invention to drawings. On the contrary, the present invention is intended to cover alternatives, modifications and equivalents, which may be included within the spirit and scope of the invention as defined by the appended claim(s).

Figure 1A:
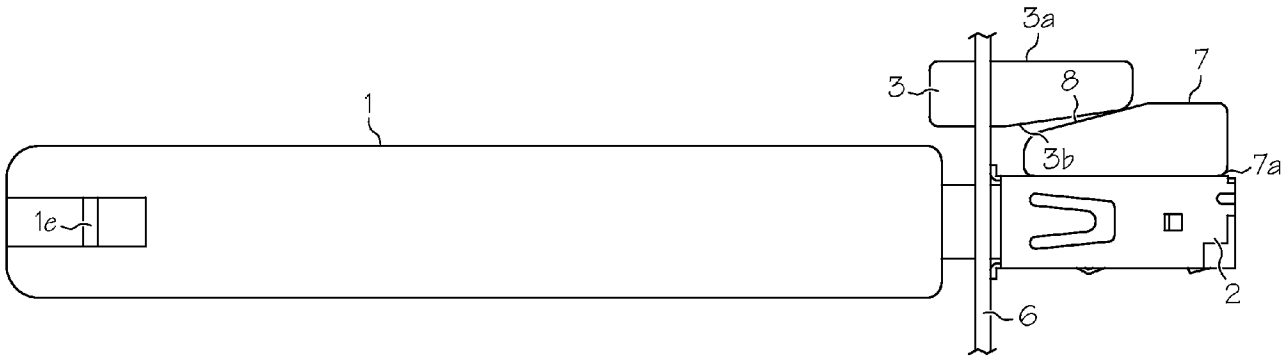
FIGS. 1*a* and 1*b* illustrates sectional side views of a panel-mounted USB male plug connector and USB female coupling connector device with a unique latching or locking mechanism in a latched condition and an unlatched condition, respectively, according to a first preferred embodiment of the present invention.
Figure 1B:
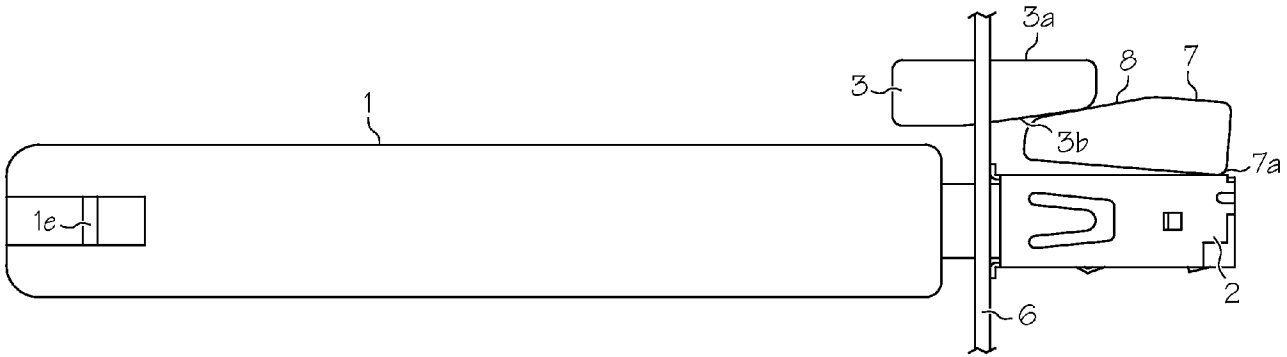

FIGS. 1*a* and 1*b* illustrate sectional side views of a panel-mount USB male plug connector 1 and female connector socket 2, a unique sliding pushbutton latching or locking actuator 3 and at least one pivoting latching or locking arm mechanism 4 in a latched (FIG. 1*a*) and unlatched conditions (FIG. 1*b*) according to the first preferred embodiments of the present invention.

Figure 2:
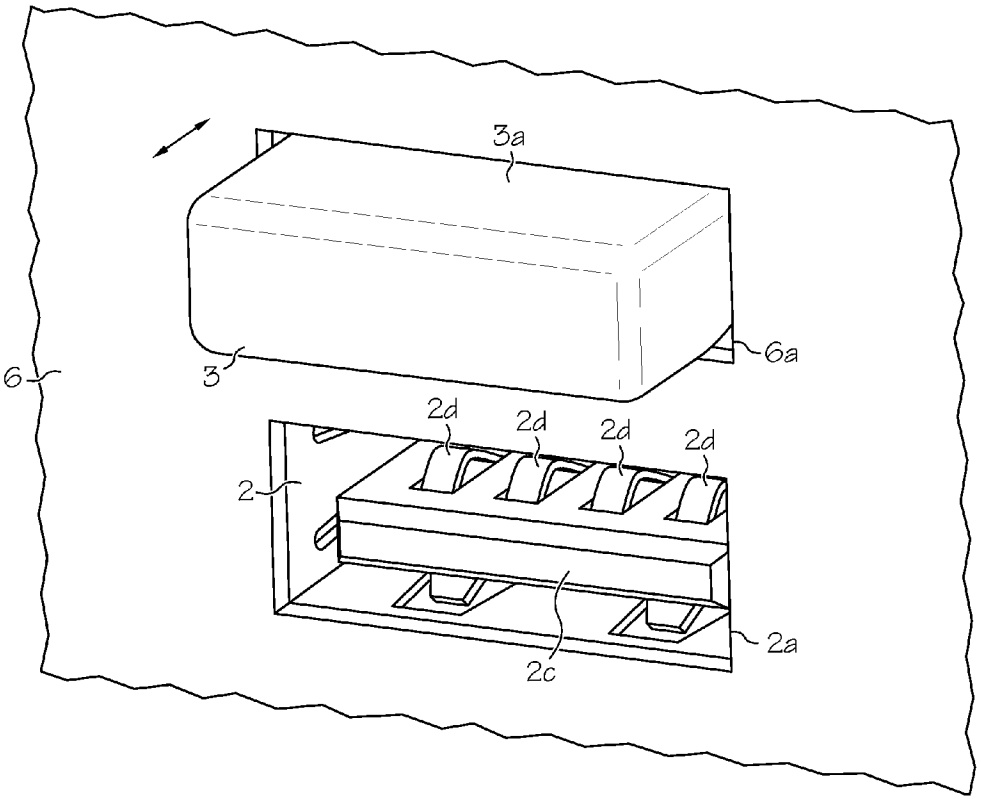
FIG. 2 illustrates a front isometric view of the panel-mounted USB female connector socket with a terminal base and a push-pull actuator for the latching or locking mechanism according to the first preferred embodiment of the present invention.
Figure 3:
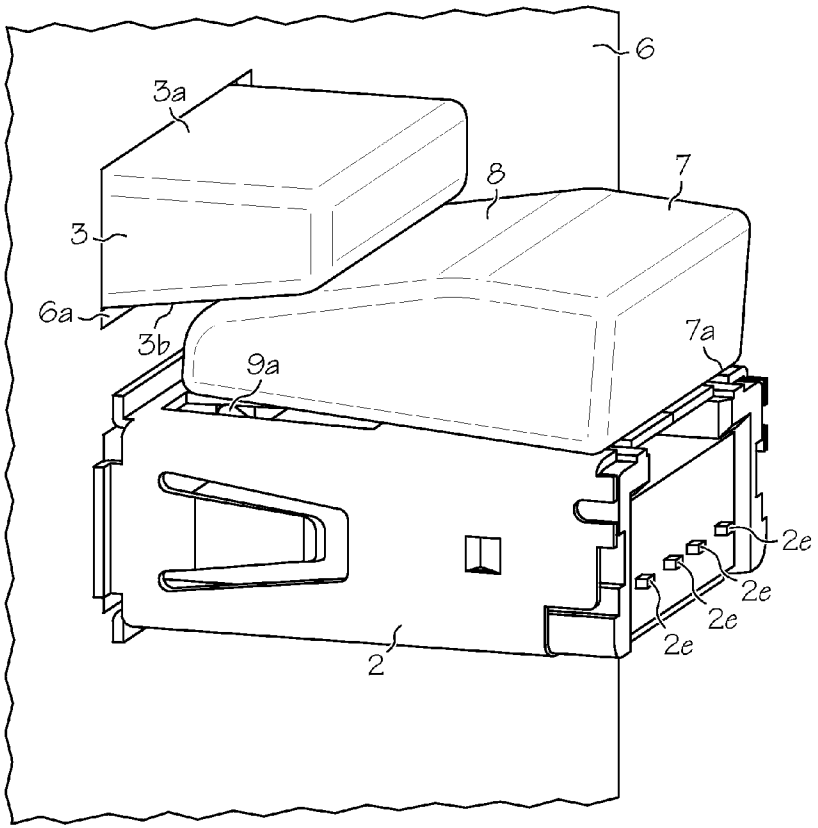
FIG. 3 illustrates a rear isometric view of the panel-mounted USB female connector socket enclosure and the push-pull actuator and a pivoted latch member of the unique latching or locking mechanism in an unlatched condition according to the first preferred embodiment of the present invention.
Figure 4:
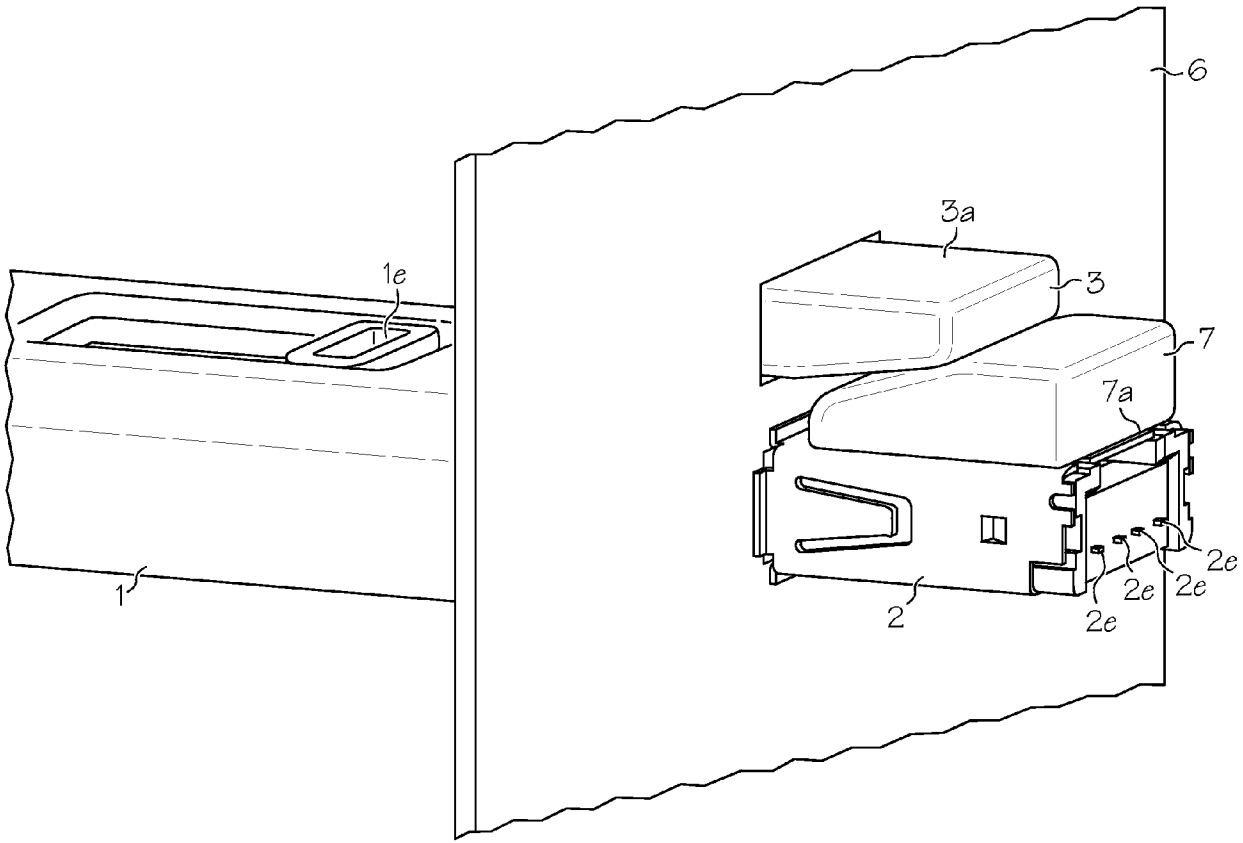
FIG. 4 illustrates a three-dimensional sectional view of a panel-mounted USB male plug connector and USB female connector socket enclosure with the push-pull actuator and the pivoted latch member of the unique latching or locking mechanism in a latched condition according to the first preferred embodiment of the present invention.
Figure 5:
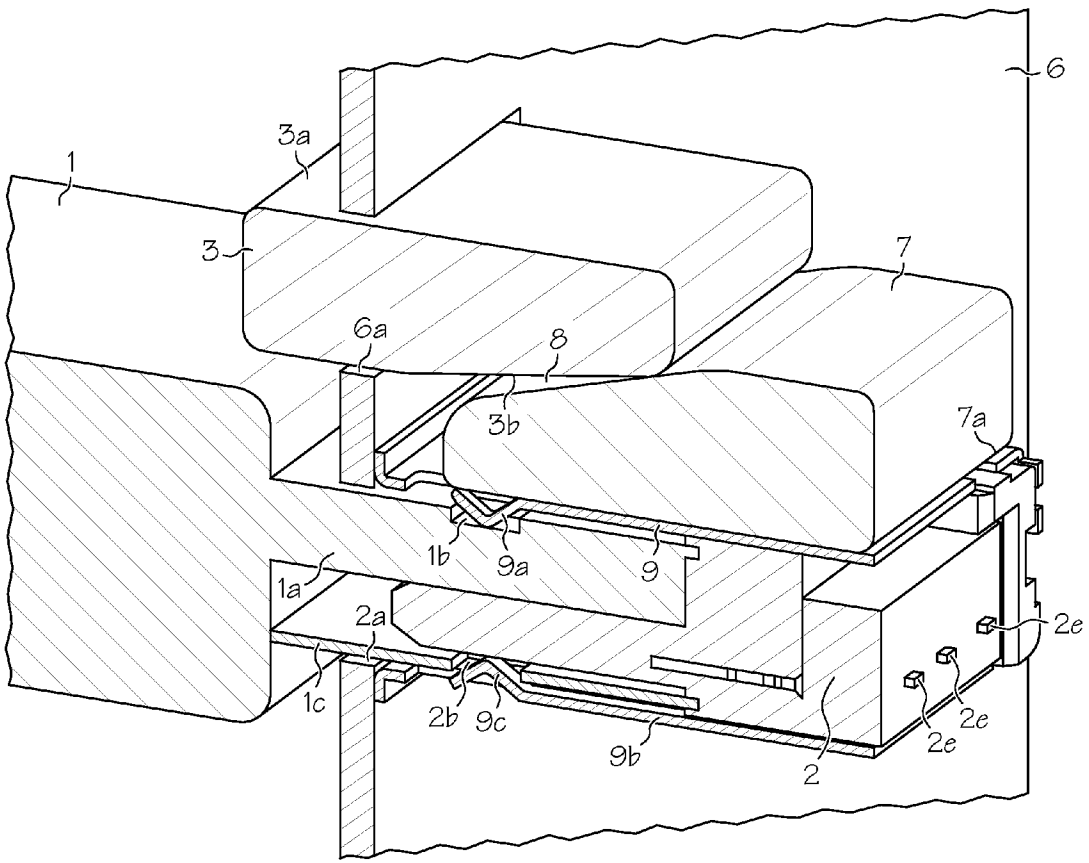
FIG. 5 illustrates a cross-sectional view of the panel-mount USB male plug connector and USB female socket connector in a plugged position with the unique latching or locking mechanism in a latching or locking condition according to the first preferred embodiment of the present invention.
Figure 6A:
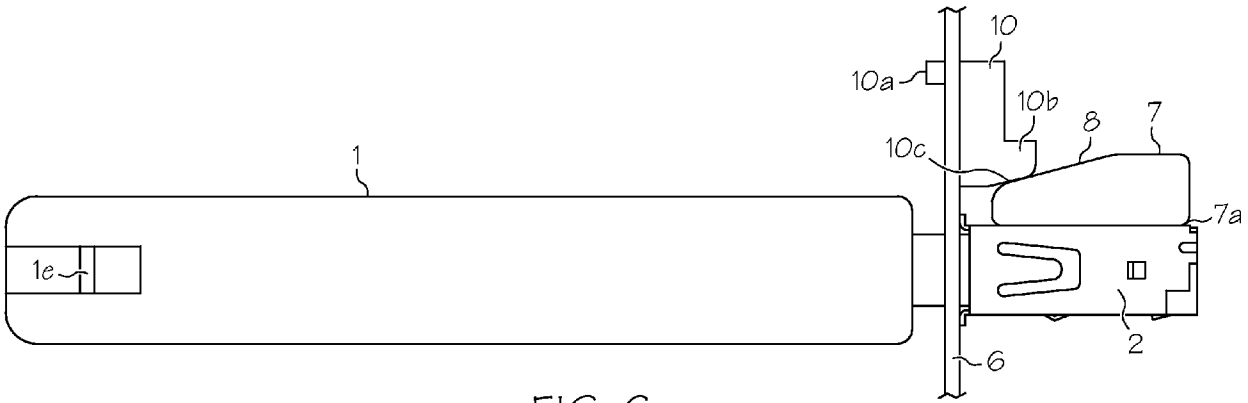
FIGS. 6*a* and 6*b* illustrates sectional side views of a panel-mount USB male plug connector and USB female socket connector with a unique latching or locking mechanism in a latched condition and an unlatched condition, respectively, according to a second preferred embodiment of the present invention.
Figure 6B:
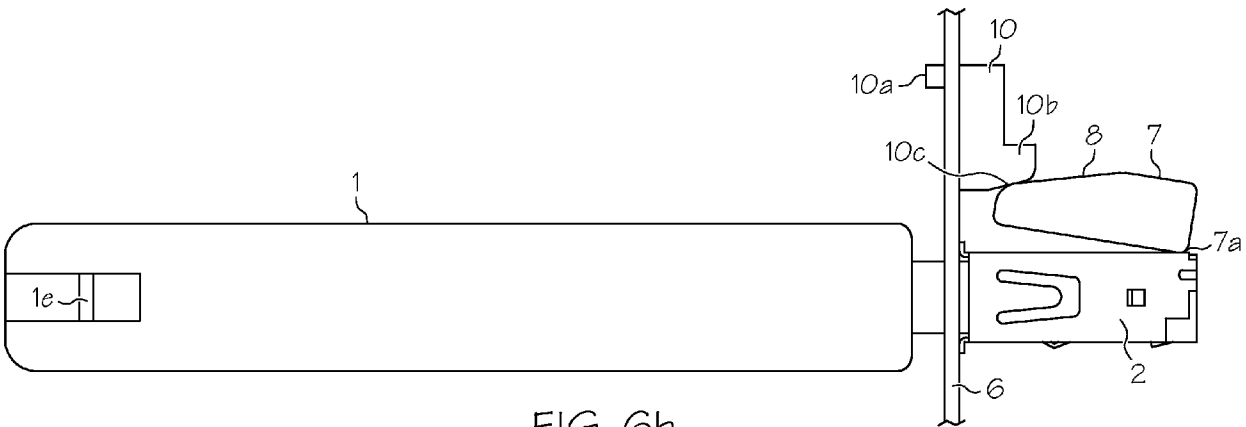
Figure 7:
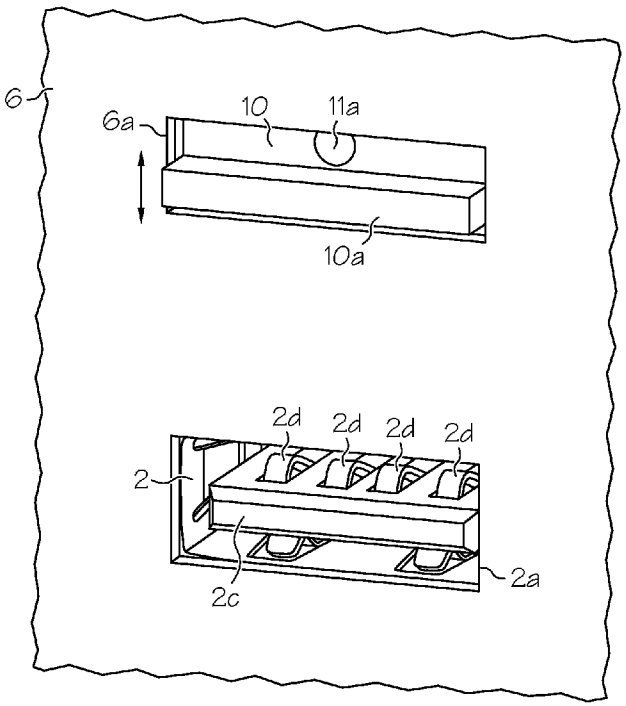
FIG. 7 illustrates a front isometric view of the panel-mounted USB female connector socket with a terminal base and a push-pull actuator for the latching or locking mechanism according to the second preferred embodiment of the present invention.
Figure 8:
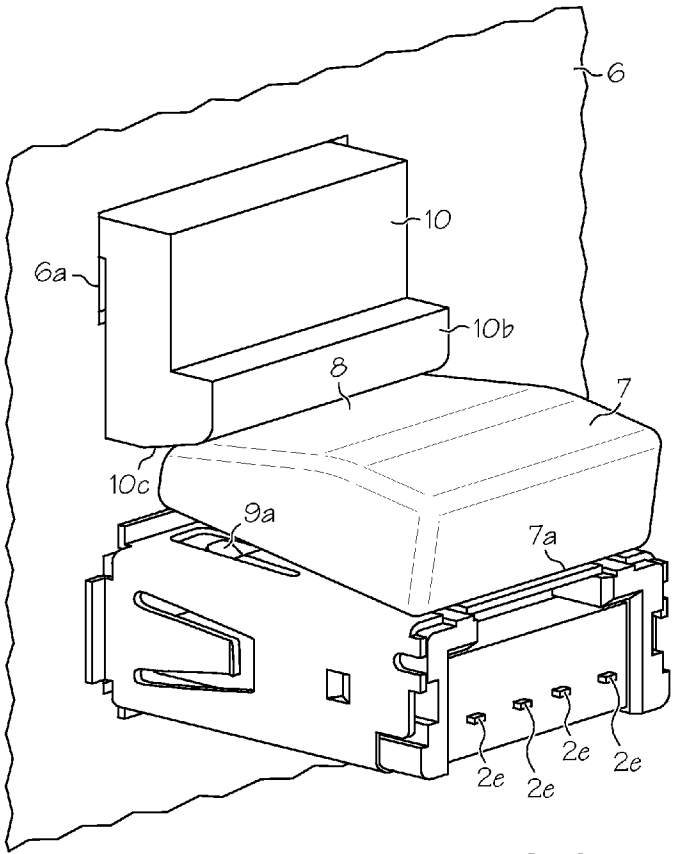
FIG. 8 illustrates a rear isometric view of the panel-mounted USB female connector socket enclosure and the push-pull actuator and a pivoted latch member of the unique latching or locking mechanism in an unlatched condition according to the second preferred embodiment of the present invention.

It will be noted here that for a better understanding, most of the like components are designated by like reference numerals throughout the various figures of the preferred embodiments. Attention is now directed to the preferred first embodiment of FIGS. 1*a*-5 where the USB female connector socket 2 is securely mounted interiorly of the panel or wall 6 through a first opening 2*a*, the USB female socket connector or enclosure 2 having a socket interior cavity (not referenced) for receiving a USB male plug connector 1. The USB male plug connector 1 includes a front coupling connector with upper and lower portions 1*a*, 1*c*, respectively, with a space (not referenced) defined between the upper and lower portions 1*a*, 1*c*, which cooperates with the USB female socket 2 interior cavity portion from the exterior side of the panel or wall 6 when the USB male plug connector 1 is to be plugged therein. In FIGS. 2 and 5 of the first preferred embodiment, the interior cavity of the female socket 2 includes a terminal base 2*c* that is disposed therein with a plurality of electrical contacts with a front contact portions 2*d* and a rear contact portion 2*e* that is secured to a rear wall of the USB female socket 2 for securing the electrical contacts therein. The USB male plug connector 1 includes an electrical track contact surface that is not shown, but engages the electrical contact portions 2*d* of the terminal base 2*c* when the male plug 1 and the female socket 2 is in engagement with one another. Also, the space of the upper and lower portions 1*a*, 1*c* slidably receives the terminal base 2*c* allowing the contact portions 2*d* to make and maintain a secure electrical contact with track contact surface when the USB male plug connector 1 is fully inserted into the USB female socket connector 2. Since the same elements are illustrated in the second preferred embodiment of FIGS. 7, 9 and 10 no further discussions of these elements will be made.

Also, the USB male plug connector 1 has a sliding release button 1*e* on a surface thereof opposite the end that receives the front coupling connector portions 1*a*, 1*b*, such that the sliding movement of the release button 1*e* allows the connector portions 1*a*, 1*b* to be retracted into and extended outward of the USB male plug connector 1. This allows the connector portions 1*a*, 1*c* to be retracted into a stored condition into the male plug connector 1 to protect the connector portions 1*a*, 1*b* from being damaged, and moving the connector portions 1*a*, 1*b* from the stored position to an outward extended position out of the male plug connector 1, so that the connector portions 1*a*, 1*b* can be inserted into the socket cavity of the USB female socket connector 2. It should be mentioned that the release button 1*e* is an optional feature that is usually not used or required on USB cable type connectors, but is required or used on some USB memory key devices.

The USB male plug connector 1 having a first latching recess 1*b* in a top surface of the upper portion 1*a* and having a second latching recess 2*b* in the lower portion 1*c*. The USB female socket enclosure 2 has an upper spring-like latch member 9 with a V-shape latching element 9*a* at a front end thereof and a lower spring-like latch member 9*b* with a V-shape latching element 9*c* at a front end thereof fixedly secured thereto in many different ways, if desired. Also, the V-shape configuration of the latching elements 9*a* and 9*c* can take on many different types of latching elements and shapes, if desired. Note that latching elements 9*a* and 9*c* are inserted into recesses 1 *b* and 2*b*, respectively, when the USB male plug connector portions 1*a* and 1*c* are inserted into the USB female socket connector 2. These latching elements 9*a* and 9*c* are further pressed and locked into the recesses 1*b* and 2*b* by a unique latching or locking structure that will be discussed in greater detail below. This unique latching or locking structure is where the main novelty of the invention lies.

The unique latching or locking structure includes a sliding push-pull actuator 3 with a top portion with a smooth or flat surface 3*a* and a lower portion with a first incline wedge or cam surface 3*b*, the first wedge or cam surface 3*b* extends substantially along a major portion thereof, the panel or wall (rear or front) 6 has a second opening 6*a* for accommodating or mounting the sliding pushbutton actuator 3 therein or there along from the exterior side, at least one pivoting latching or locking arm or member 7 with a top surface with a second wedge or cam surface 8 disposed along a front portion thereof adjacent the interior panel or wall 6, and the at least one pivoting latching or locking arm or member 7 has a flat bottom surface along its entire length thereof The latching elements 9*a* and 9*c* will spring into the first and second latching recesses 1*b*, 2*b*, respectively, when the latching elements 9*a*, 9*c* and latching recesses are in alignment with another for securely latching or locking the male plug portion la in the socket cavity of the USB female socket connector 2, after the USB connector portions 1*a*, 1*c* is fully inserted therein.

The operation of the panel-mount USB locking or latching structure 3, 7 is very simple and easy to accomplish. This operation is performed initially by the push-pull actuator 3 being grasped by a user and moved inward along and through the second opening 6*a*. This continued movement pushes the at least one pivoting latching or locking arm 7 downward against the spring-like latch 9, as the first and second wedge or cam surfaces move along one another until they become wedged tightly against one another into a secure latching or locking position. Such secure latching or locking position is achieved when the male plug connector portions 1*a*, 1*c* are inserted into the interior cavity of the socket connector 2, the upper and lower spring-like latching elements 9*a*, 9*c* will flex and ride along a portion of connector portions 1*a*, 1*c*, respectively, until the V-shape latching elements 9*a*, 9*c* spring into the first and second latching recesses 1*b*, 2*b*, respectively. This latching or locking position maintains the male plug 1 within the female socket connector 2, until the actuator 3 is grasped by a user and moved outward from within the opening 6*a*, which allows the latching arm 7 to pivot upward and the V-shape latching elements 9*a*, 9*c* will move and spring out of the first and second latching recesses 1*b*, 2*b* as the connector portions 1*a*, 1*c* is moved outwardly and engage the V-shape latching elements to cam them out of their respective latching recesses 1*b*, 2*b*, to permit the male plug 1 to be easily disconnected from the female socket connector 2. Note that the rear end or portion 7*a* is pivotally hinged or spring biased relative to the female socket connector 2 or to the interior of a computer system or other electronic equipment. However, many other types of mechanical pivoting connecting arrangements could be utilized such as, a pin and spring connection, pin and bearing structure, spring hinge member, to name just a few, if desired. Such would be obvious to one of ordinary skill in the art, at the time the invention was made.

Therefore, this unique latching or locking connector structure protects the male plug portion 1*a* from being inadvertently unplugged or disassembled from the female socket connector enclosure 2 when an external force is applied thereto.

Attention is now directed to the preferred second embodiment of FIGS. 6*a*-10 where most of same referenced numerals as depicted in FIGS. 1*a*-5 are applicable to the same features as shown in FIGS. 6*a*-10. The difference between FIGS. 1*a*-5 and FIGS. 6*a*-10 lies in the different configurations of the push-pull actuators 3 and 10. Note that both of the different configurations of the push-pull actuators 3 and 10 are utilized and accommodated in an opening labeled 6*a*. Note that the opening 6*a* in FIGS. 6*a*-10 is positioned higher up in the panel than the opening 6*a* in FIGS. 1*a*-5. However, the overall latching or locking concept and the similar referenced characters as shown in FIGS. 6*a*-10 perform the same identical operation in the same manner as discussed in FIGS. 1*a*-5 to overcome inadvertent unplugging or disconnection of the male plug portion 1 from the female socket connector 2. For better clarity and understanding, the push-pull actuator 10 will now be described in greater details.

Figure 9:
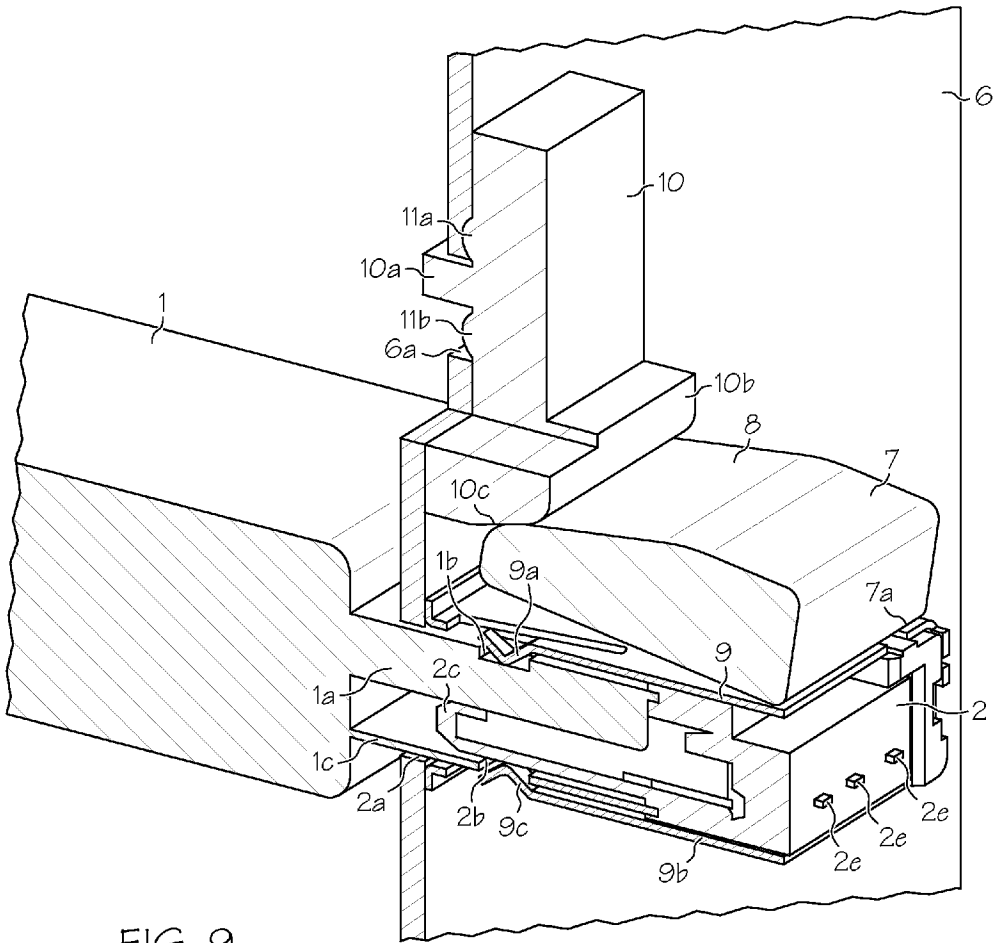
FIG. 9 illustrates a three-dimensional sectional view of the panel-mounted USB male plug connector and USB female connector socket enclosure with the push-pull actuator and the pivoted latch member of the unique latching or locking mechanism in an unlatched condition according to the second preferred embodiment of the present invention.
Figure 10:
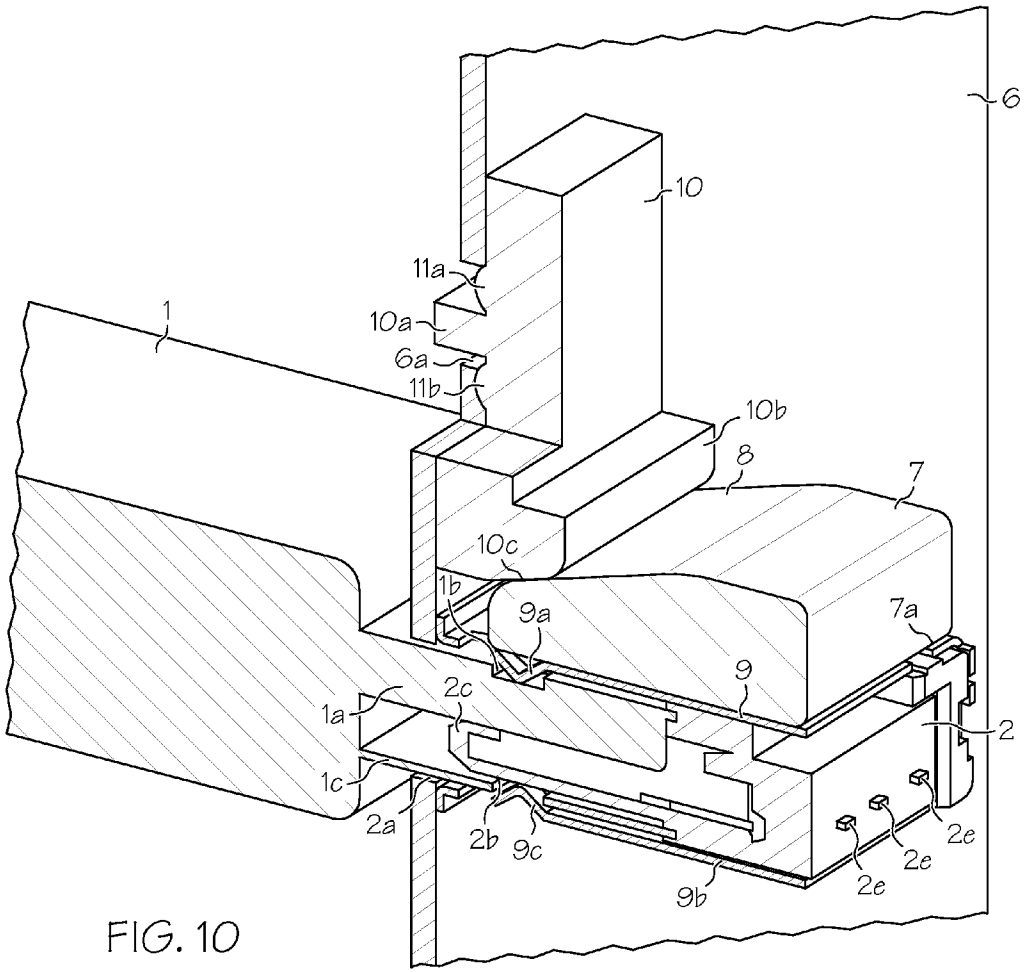
FIG. 10 illustrates a three-dimensional sectional view of the panel-mount USB male plug connector and the USB female socket connector in a plugged position with the unique latching or locking mechanism in a latching or locking condition according to the second preferred embodiment of the present invention.

The opening 6*a* is elongated and oriented in a horizontal direction in the panel or wall 6 for receiving the actuator 10. The actuator 10 includes at least a pair of flexible or spring-like stop or detent members 11*a*, 11*b* positioned on a front face thereof above and below a handle portion 10*a*. Note that the front face of the actuator 10 is positioned against the interior wall surface of the panel 6 and being maintained against the interior wall surface by a retaining structure not shown with the handle portion 10*a* extending through the opening 6*a* outwardly to the exterior of the panel 6. The handle portion 10*a* moves vertically along the opening 6*a* in up and down directions. As shown in FIG. 9, when the handle portion 10*a* is moved by a user in an upward direction and abuts against an upper surface of the openings 6*a*, the stop or detent member 11*a* flexes just enough to be wedged against the interior wall surface of panel 6 for the holding the actuator 10 in an unlatched position. In FIG. 10, the handle 10*a* is moved in a reverse direction to a latched position. The operation of the latching or locking structure 7, 10 in conjunction with the USB male plug connector 1 and female socket connector 2 will be discussed in greater detail below. This operational concept is very similar to the operational concept of FIGS. 1*a*-5.

As illustrated in FIGS. 6*a*-10, the operation of the panel-mount USB locking or latching structure 7, 10 is very simple and easy to accomplish in the same manner as discussed above in FIGS. 1*a*-5. This operation is performed initially by the push-pull actuator handle portion 10*a* being grasped by a user and moved upward and downward along and through the panel opening 6*a*. This continued movement pushes the at least one pivoting latching or locking arm 7 downward against the spring-like latch 9, as a third wedge or cam surface 10*c* and the second (same as in FIGS. 1*a*-5) wedge or cam surface 8 move along one another until they become wedged tightly against one another into a secure latching or locking position. Such secure latching or locking position is achieved when the male plug connector portions 1*a*, 1*c* are inserted into the interior cavity of the socket connector 2, the upper and lower spring-like latching elements 9*a*, 9*c* will flex and ride along a portion of connector portions 1*a*, 1*c*, respectively, until the V-shape latching elements 9*a*, 9*c* spring into the first and second latching recesses 1*b*, 2*b*, respectively. This latching or locking position maintains the male plug 1 within the female socket connector 2, until the actuator handle portion 10*a* is grasped by a user and moved upward along and within the opening 6*a*, which allows the latching arm 7 to pivot upward and the V-shape latching elements 9*a*, 9*c* will move and spring out of the first and second latching recesses 1*b*, 2*b* as the connector portions 1*a*, 1*c* is moved outwardly and engage the V-shape latching elements 9*a*, 9*c* to cam them out of their respective latching recesses 1*b*, 2*b*, to permit the male plug connector 1 to be easily disconnected from the female socket connector 2. Note that the rear end of portion 7*a* is pivotally hinged or spring biased relative to the female socket connector 2 or to the interior of a computer system or other electronic equipment. However, many other types of mechanical pivoting connecting arrangements can be utilized in the same manner as discussed in FIGS 1*a*-5.

In conclusion, since the actuator and latching structures as depicted in FIGS. 1*a*-10 is a simple arrangement it opens up more possibilities for incorporating various other types of actuators with the claimed latching structures to achieve the same result.

The foregoing descriptions of the specific embodiments of FIGS. 1*a*-10 have been presented for purposes of illustration and description. They are not intended to be exhaustive or to limit the present invention to the precise forms disclosed, and obviously many modifications and variations are possible in the light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined as set forth in the following claim(s).

What is claimed is:

1. A method of removably coupling and latching a USB connector assembly, the method comprising:

providing a panel with a first and second openings therein;

providing a USB female connector with a front portion having a socket member that is mounted within the first opening, the socket member have at least a pair of spring-like latch members disposed on upper and lower surfaces of the socket member with a latching element on a front portion of the at least a pair of spring-like latch members;

providing a USB male plug connector with a front coupling portion with upper and lower connector portions, each of the upper and lower portions having at least first and second latching recesses disposed therein;

providing a push-pull actuator that is slidably received within the second opening of the panel, the push-pull actuator having a first incline cam element disposed on a surface thereof;

providing a pivoting latch arm that is cooperatively associated with a portion of the USB female connector, the pivoting latch arm has a front portion with a second incline cam element disposed on a top portion thereof; and inserting the USB male plug coupling portion fully into the female socket member until the at least first and second latching recesses are in alignment and in engagement with the each of the latching elements, then moving the push-pull actuator along the second opening in a first direction causing the first incline cam element to engage the second incline cam element, wherein the engaging of the first and second cam elements generates a latching force that pivots the latch arm downward and directly against the upper latching member for maintaining each of the latching elements in the first and second latching recesses for securely latching the male plug connector and the female socket connector together and guarding against inadvertent unplugging or disassembling when an external force is applied thereto, the disconnection of the male plug connector and the female socket connector is achieved by moving the push-pull actuator in a second direction along the second opening causing the first incline cam element to disengage from the second incline cam element, thereby pivoting the latch arm upward and releasing the latching force applied to each of the latching elements so that each latching elements are able to flex away from the first and second latching recesses to permit the male plug connector to be easily separated from the female socket connector when a pull force is applied.

* * * * *